US010357098B2

(12) United States Patent
Grace

(10) Patent No.: US 10,357,098 B2
(45) Date of Patent: Jul. 23, 2019

(54) CARRYING STRAP FOR FOLDING FURNITURE

(71) Applicant: Daniel R. Grace, Old Saybrook, CT (US)

(72) Inventor: Daniel R. Grace, Old Saybrook, CT (US)

(73) Assignee: GCI OUTDOOR, INC., Higganum, CT (US)

( * ) Notice: Subject to any disclaimer, the term of this patent is extended or adjusted under 35 U.S.C. 154(b) by 481 days.

(21) Appl. No.: 15/149,392

(22) Filed: May 9, 2016

(65) Prior Publication Data

US 2016/0324322 A1 Nov. 10, 2016

Related U.S. Application Data

(63) Continuation-in-part of application No. 14/991,054, filed on Jan. 8, 2016, now Pat. No. 10,051,954.

(60) Provisional application No. 62/158,691, filed on May 8, 2015.

(51) Int. Cl.

| | |
|---|---|
| ***A47C 4/28*** | (2006.01) |
| ***A47C 4/52*** | (2006.01) |
| ***A45F 3/14*** | (2006.01) |

(52) U.S. Cl.

CPC ..... *A45F 3/14* (2013.01); *A47C 4/286* (2013.01); *A47C 4/52* (2013.01); *A45F 2003/142* (2013.01)

(58) Field of Classification Search

CPC ..... A47C 4/286; A47C 4/52; A45F 3/14
USPC ..... 297/45, 17; 224/155
See application file for complete search history.

(56) References Cited

U.S. PATENT DOCUMENTS

| | | | | |
|---|---|---|---|---|
| 2,922,465 A | | 1/1960 | Johansson et al. | |
| 3,250,449 A | | 5/1966 | Woodman | |
| 4,300,707 A | | 11/1981 | Kjaer | |
| 4,487,345 A | | 12/1984 | Pierce et al. | |
| 4,577,901 A | | 3/1986 | Phillips | |
| 4,676,548 A | | 6/1987 | Bradbury | |
| 4,718,715 A | | 1/1988 | Ho | |
| 4,720,029 A | | 1/1988 | Varanakis | |
| 4,747,526 A | | 5/1988 | Launes | |
| 5,016,792 A | | 5/1991 | Jay | |
| 5,058,949 A | * | 10/1991 | Von Hoffman | A47C 4/286 297/45 |
| 5,087,095 A | | 2/1992 | McFate | |
| 5,139,308 A | | 8/1992 | Ziman | |
| 5,297,708 A | | 3/1994 | Carpenter | |
| 5,318,342 A | | 6/1994 | Hale | |
| 5,409,291 A | | 4/1995 | Lamb et al. | |
| 5,415,455 A | * | 5/1995 | Geldbaugh | A47C 4/02 297/45 |

(Continued)

FOREIGN PATENT DOCUMENTS

CA 2038986 A1 9/1992

*Primary Examiner* — Anthony D Barfield
(74) *Attorney, Agent, or Firm* — McCormick, Paulding & Huber LLP

(57) ABSTRACT

A folding chair has a carrying strap attached across the chair from a top brace to a rear leg of the chair. The carrying strap may pass across the chair's center of gravity. Alternatively, the carrying strap may be offset from the chair's center of gravity and may have an upper end made sufficiently broad so as to resist a swinging force imparted by the offset. Duplicate carrying straps may be provided to enable carrying the chair like a backpack.

11 Claims, 5 Drawing Sheets

(56) References Cited

U.S. PATENT DOCUMENTS

| | | | | | |
|---|---|---|---|---|---|
| 5,429,413 | A * | 7/1995 | Levy | A47C 1/143 | 297/45 X |
| 5,501,505 | A | 3/1996 | Jablonski | | |
| 5,527,088 | A | 6/1996 | MacLean | | |
| 5,536,064 | A | 7/1996 | MacLean | | |
| 5,538,318 | A | 7/1996 | MacLean | | |
| 5,547,246 | A | 8/1996 | Lambert | | |
| 5,588,570 | A | 12/1996 | Zirbel | | |
| 5,588,696 | A | 12/1996 | Jay et al. | | |
| 5,628,437 | A | 5/1997 | Kober | | |
| 5,988,737 | A * | 11/1999 | Tomaiuolo | A47C 4/52 | 297/129 |
| 6,095,599 | A | 8/2000 | Lambert | | |
| 6,549,324 | B2 | 4/2003 | Ammann, Jr. | | |
| RE39,022 | E | 3/2006 | Welsh | | |
| 7,644,981 | B2 * | 1/2010 | Hensley | A47C 4/32 | 297/17 X |
| 8,197,000 | B1 * | 6/2012 | Cohen | A47C 4/30 | 297/17 X |
| 8,303,032 | B1 * | 11/2012 | Platta | A47C 4/286 | 297/45 X |

* cited by examiner

CARRYING STRAP FOR FOLDING FURNITURE

CROSS-REFERENCE TO RELATED APPLICATIONS

This application claims the benefit under 35 USC § 119(e) of U.S. Provisional Application No. 62/158,691 filed May 8, 2015, the disclosure of which is hereby incorporated by reference in its entirety. This application is a continuation-in-part of U.S. patent application Ser. No. 14/991,054 filed Jan. 8, 2016 now U.S. Pat. No. 10,051,954, the disclosure of which is hereby incorporated by reference in its entirety.

TECHNICAL FIELD OF THE INVENTION

The invention relates to folding furniture. Particular embodiments relate to modes of carrying a folding furniture item.

BACKGROUND OF THE INVENTION

Folding furniture is well known and is popular for use in many endeavors. For example, folding chairs are used at the beach, for picnics, and at the sidelines of amateur sporting events. The general intent of folding furniture is ease of storage and portability—i.e., the furniture can be set-up for use and then folded down for transport and/or storage in a space of smaller volume than what the furniture occupies in its set-up condition. It also has been noted that it would be desirable to have the furniture fold down to fit within a space of minimum possible perimeter—i.e., for purposes of shipping the furniture at a minimal rate when the shipping rate is based in part on the volume and perimeter of the package to be shipped. However, the collapsibility of known folding furniture has been limited by certain design features, for example, the mutual arrangement of members to fold against each other without needing to disassemble and reassemble the article. Additionally, it would be desirable to have a folding article of furniture that does not easily or unintentionally collapse from its set-up condition, especially when in use, and that tends to remain in its folded condition, for example, during storage and/or transport.

On many items of folding furniture, carrying straps are provided for user convenience. However, certain problems exist with known arrangements of carrying straps. In particular, conventional carrying straps provide for shoulder carry of folded furniture items. The conventional straps typically are secured to the folding furniture at about the midline (center of gravity), which results in a tendency of the folding furniture to overturn while being carried. Additionally, a large part of the folding furniture may protrude above the carrying strap into a carrier's armpit. Accordingly, it would be desirable to have a carrying strap that attaches to a folding article of furniture such that the furniture item can be carried under the arm or across the back with minimal discomfort to the carrier.

SUMMARY OF THE INVENTION

According to embodiments of the invention, in a set-up configuration of a folding portable article of furniture (e.g., a chair, although other articles of furniture can be similarly constructed as will be apparent to ordinary skilled workers), the article includes a plurality of pivotally interconnected frame members as well as a first plurality of pivots or joints that define mutually parallel axes about which the article can be folded in a single motion from the set-up configuration to a flattened configuration. The article also includes a second plurality of pivots or joints that define mutually skewed axes about which the frame cannot be folded from the set-up configuration. However, in the flattened configuration of the article, the second plurality of pivots then define parallel axes about which the article can be folded from the flattened configuration to a collapsed configuration. Thus, the first and second pluralities of pivots provide for the article to be an item of "bi-fold" furniture to reduce the footprint (perimeter) of the article in its fully collapsed condition.

The present invention is directed to embodiments that provide at least one carrying strap that is attached to a folding chair across its center of gravity, e.g., at a top member of a back rest and at a side member of a rear leg. Advantageously, attachment of the carrying strap across the center of gravity provides for more comfortable carrying with a greatly reduced tendency to overturn.

Thus, according to some embodiments, a folding chair has a carrying strap attached across the chair from a top brace to a rear leg of the chair. The carrying strap may pass across the chair's center of gravity. According to other embodiments, the carrying strap may be offset from the chair's center of gravity and may have an upper end made sufficiently broad so as to resist a swinging force imparted by the offset. In alternate embodiments, two carrying straps may be provided so as to permit carrying the chair in a flat folded condition much like a backpack. Still further, the chair frame may have a bi-fold condition, in which case one may carry the folded chair using one or both of the straps as a shoulder strap.

These and other features of the present invention are described with reference to the drawings of preferred embodiments of a folding chair. The illustrated embodiments and features of the present invention are intended only to illustrate, but not to limit the invention.

DETAILED DESCRIPTION

Figure 1:
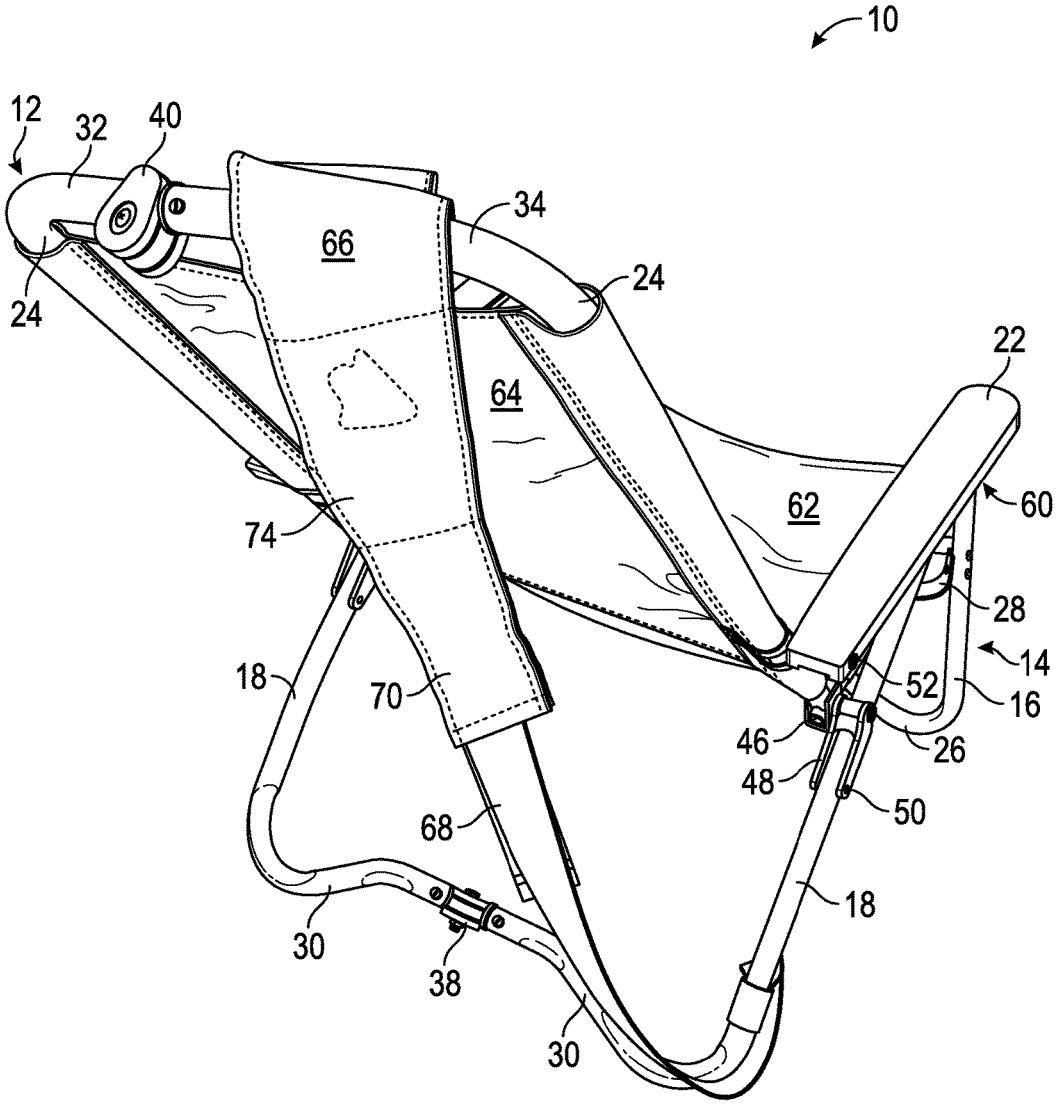
FIG. 1 shows a bi-fold chair, in accordance with a first embodiment of the present invention, in a set-up configuration.
Figure 2:
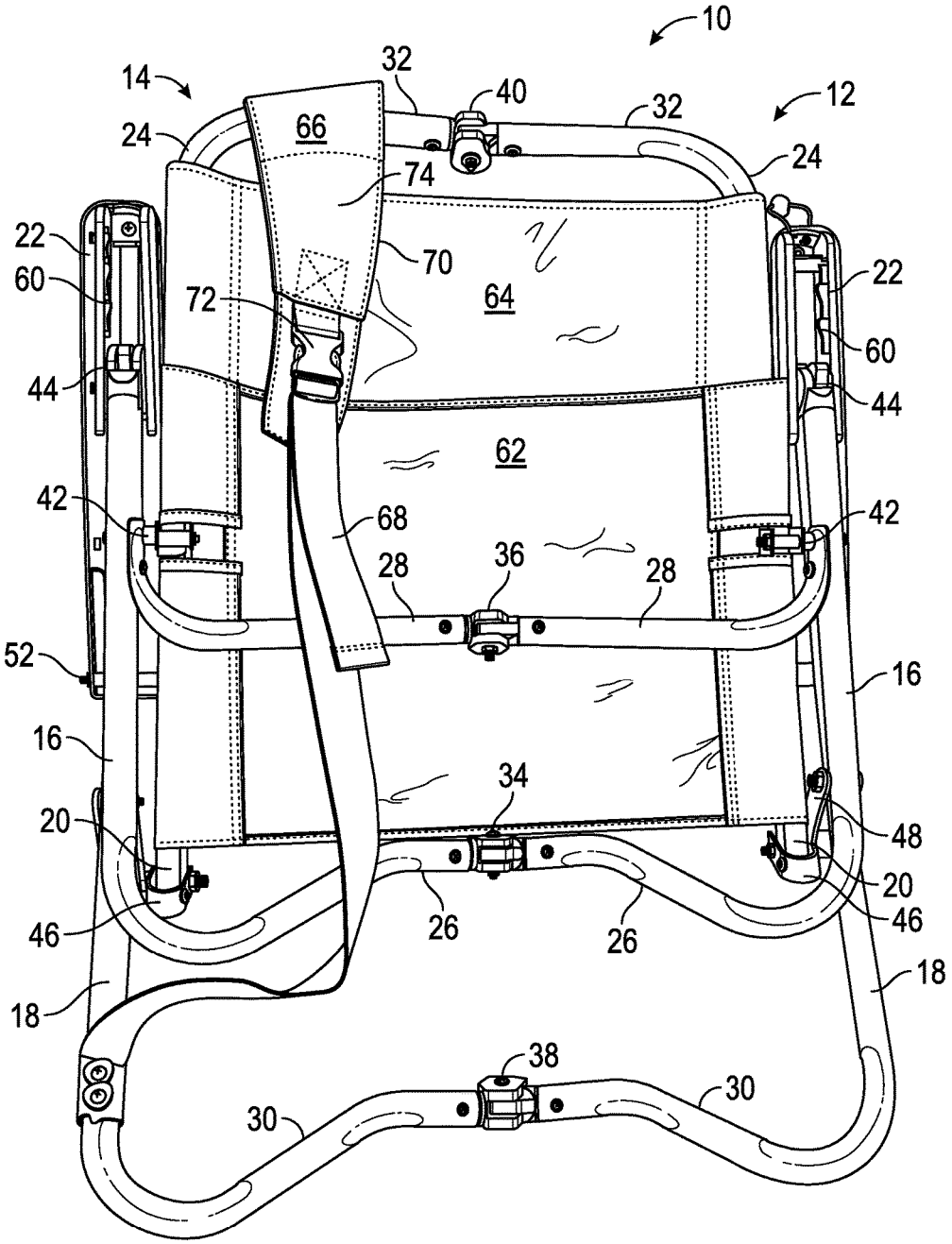
FIG. 2 shows the bi-fold chair of FIG. 1 in a flattened configuration.
Figure 3:
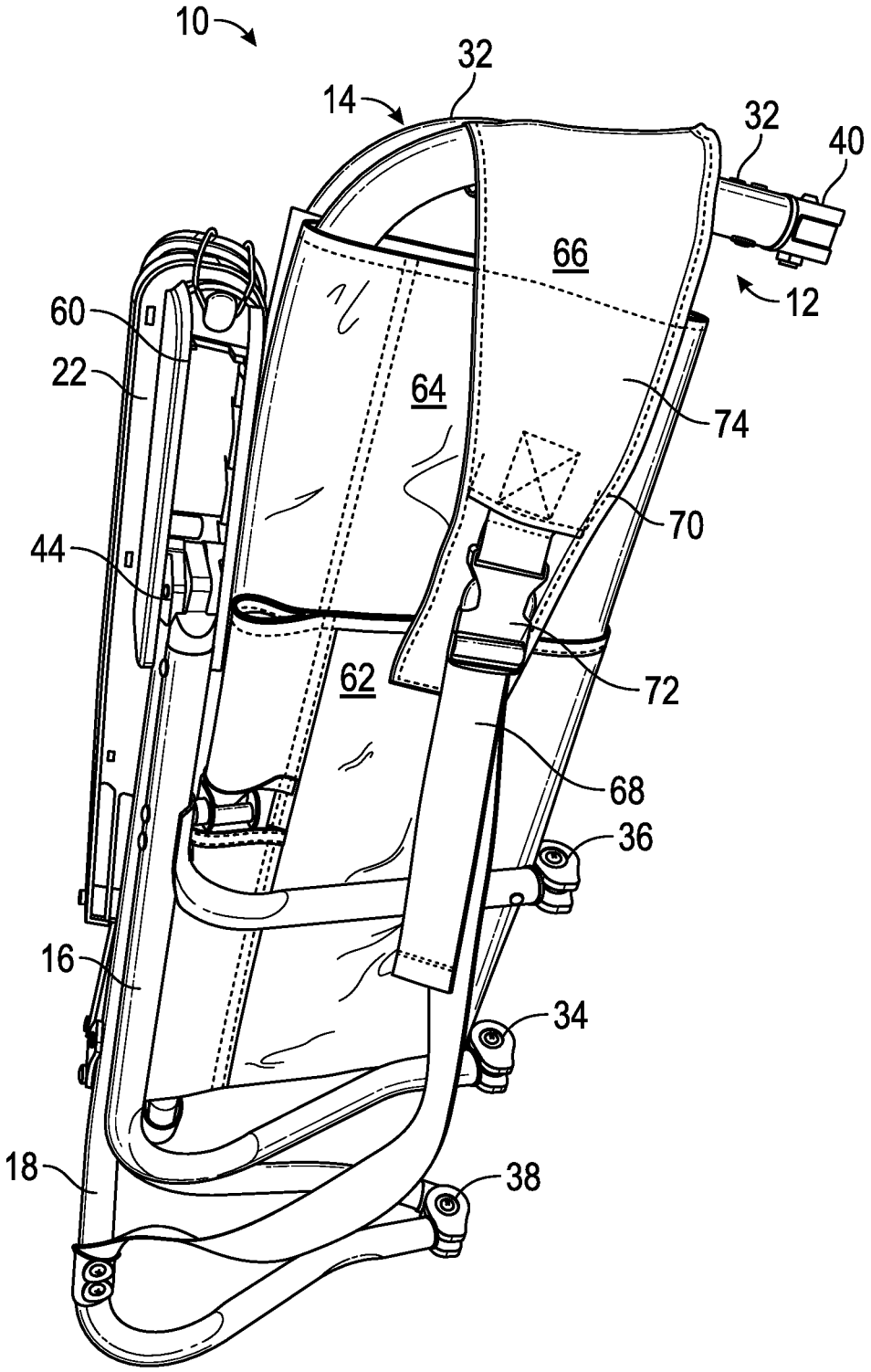
FIG. 3 shows the bi-fold chair of FIGS. 1 and 2 in a collapsed configuration.

Referring to FIGS. 1 through 3, a collapsible chair 10 in accordance with the present invention includes left and right pluralities of side frame members that support fabric panels. The side frame members are directly pivotally connected with each other, and also are connected by cross members. The cross members are rigidly and generally orthogonally connected to the side frame members. In intended operation of the chair 10, the side frame members and cross members collectively pivot relative to one another to move the chair between a set-up condition and a collapsed condition. In accordance with an embodiment illustrated in FIGS. 1-3, the cross members are mutually pivotally connected at a vertical mid-plane of the chair so as to permit folding of the frame in the collapsed condition to a smaller, bi-fold footprint such as shown and described in Applicant's co-pending U.S. patent application Ser. No. 14/991,054.

More particularly, the side frame members are arranged symmetrically in a left plurality 12 and a right plurality 14. Each plurality 12 or 14 of side frame members includes a front leg 16, a rear leg 18, a seat support 20, an arm rest 22, and a back support 24. The front legs 16 are cross-connected by lower leg braces 26 and upper leg braces 28. The rear legs 18 are cross-connected by rear braces 30. The back supports 24 are cross-connected by top braces 32.

Each lower leg brace 26 is rigidly attached to its respective front leg 16, and is pivotally connected by a lower joint 34 to the other lower leg brace 26. Each upper leg brace 28 is rigidly attached to its respective front leg 16, and is pivotally connected by an upper joint 36 to the other upper leg brace 28. Each rear brace 30 is rigidly attached to its respective rear leg 18, and is pivotally connected by a rear joint 38 to the other rear brace 30. Each top brace 32 is rigidly attached to its respective back support 24, and is pivotally connected by a top joint 40 to the other top brace 32.

Each front leg 16 is pivotally connected to its respective seat support 20 by a front joint 42, and is pivotally connected to its respective rear leg 18 by a wrist joint 44. Each seat support 20 is pivotally connected to its respective back support 24 by a seat joint 46. Each seat joint 46 also connects its respective seat support 20 and back support 24 to a crank 48, which is connected by a crank joint 50 to the respective rear leg 18. Finally, each arm rest 22 is pivotally connected to its respective back support 24 by an elbow joint 52, and is adjustably attached to its respective front leg 16 (at or near the wrist joint 44) by a ratchet mechanism 60.

Each member of the chair has a diameter or thickness, and conventionally all members of such chairs have been of a uniform diameter or thickness. Also, conventionally, the members of such chairs have been arranged in a stacked configuration in which they fold down against each other. Thus, for an arrangement of four side frame members, the known chairs when fully folded occupy the thickness of four side frame members.

With reference to the set-up configuration of the chair 10, as shown in FIG. 1, the left and right pluralities 12, 14 of the side frame members are spaced apart by the cross members to tension a flexible seat panel 62 and a flexible back panel 64 that are attached between the side frame members. A flexible carrying strap 66 is attached at one of the top braces 32 and at one of the rear legs 18. The carrying strap 66 includes a web lower end 68 as well as a padded upper end 70. The lower end 68 connects to the upper end 70 by way of a side-release buckle 72. On the upper end 70 a pocket 74 is provided for holding a cell phone, a wallet, etc. The carrying strap 66 is attached at the upper end 70 to the top brace 32 and is attached at the lower end 68 to the rear leg 18. The ends of the carrying strap 66 are attached to the chair 10 by forming loops that are fastened to the chair frame by screws 76 or by similar fasteners. The inventive carrying strap 66 attaches to the top brace 32 and to the side member of the rear leg 18. Thus, the carrying strap 66 falls behind the back rest 64 in the set up condition of the folding chair 10, with the pocket 74 opening toward the back of the chair 10, as illustrated in FIG. 1.

In the set-up configuration of the chair 10, a first plurality of joints 34, 36, 38, 40 define a plurality of mutually skewed axes, all in the vertical mid-plane of the chair, about which the chair 10 cannot be folded from its set-up configuration. On the other hand, a second plurality of joints 42, 44, 46, 50, 52 define a plurality of mutually parallel axes, about which the left and right pluralities of side frame members of the chair 10 can be folded together from the set-up configuration of the chair to a flattened configuration as shown in FIG. 2.

Figure 5:
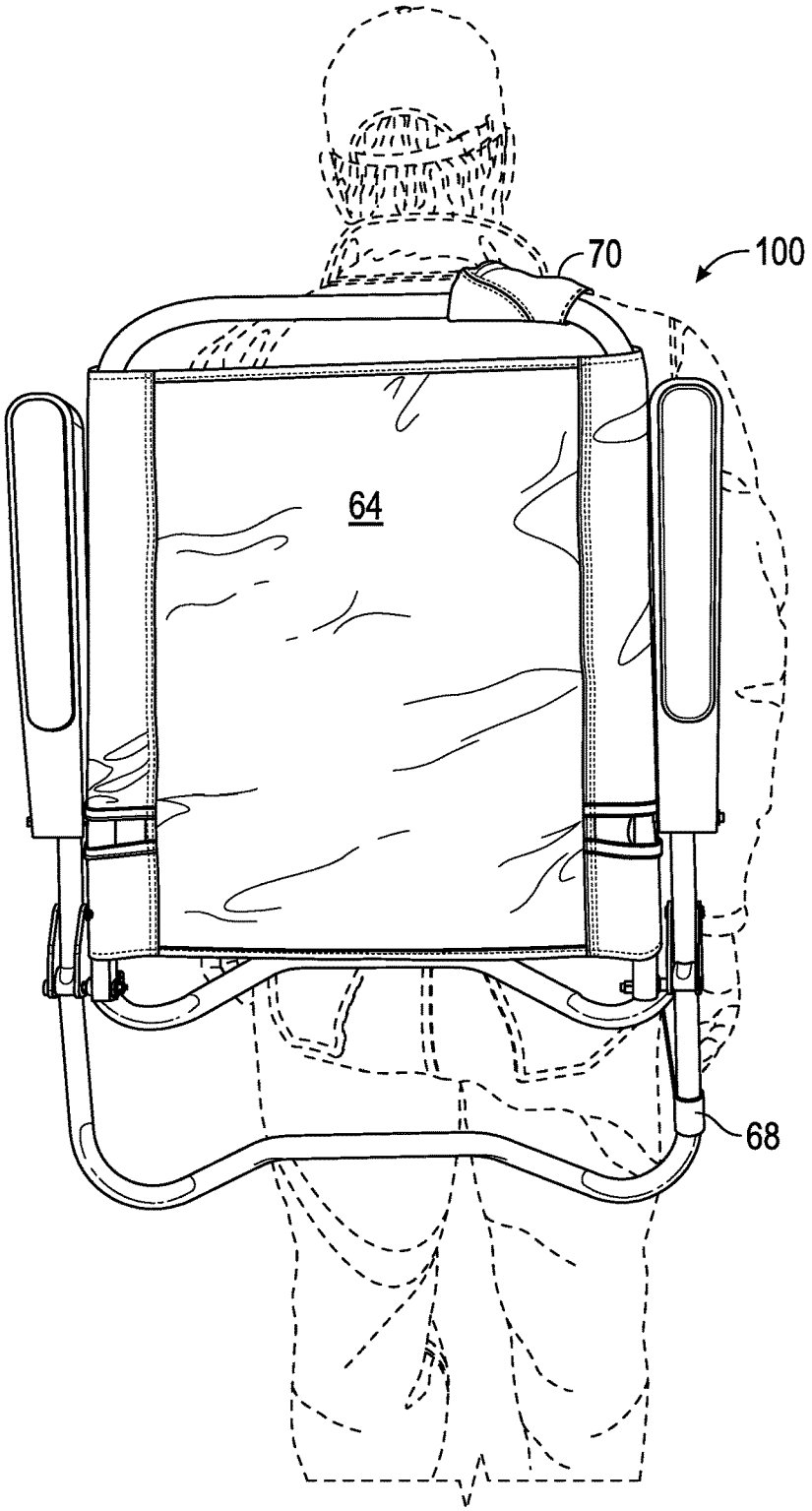
FIG. 5 shows a flattened folding chair being carried over a carrier's shoulder, according to a second embodiment of the present invention.

Referring further to FIG. 2, the chair 10 is shown in a flattened configuration common to collapsible chairs. In the flattened configuration of the chair 10, the side frame members 16, 18, 20, 22, 24 of the left plurality 12 are bundled closely together while the side frame members of the right plurality 14 also are bundled closely together. The side frame members of the seat support and of the back support are nested laterally between the other side frame members (e.g., legs and armrests). Thus, the cross members or braces 26, 28, 30, 32 are brought substantially into a common plane orthogonal to the vertical mid-plane of the chair, such that the joints 34, 36, 38, 40 are brought substantially into line with each other, i.e., the formerly skewed axes now are made substantially coaxial. In such a substantially coplanar or nested configuration, the folded chair occupies not more than about two side frame members thicknesses due to at least some of the side frame members being laterally nested (not folded against each other). In this regard, the carrying strap 66 can be used with folding chairs foldable to such a condition, whether the frame can be further collapsed (such as shown in FIG. 3) or not. Indeed, use of the carrying strap 66 with a folding chair that collapses only to a flattened configuration is illustrated in FIG. 5.

Also visible in FIG. 2 are the pocket 74 formed on the carrying strap 66, as well as the buckle 72 that fastens together the upper end 70 and the lower end 68 of the carrying strap 66. The buckle 72 is shown as a side-release buckle but can alternatively be a slide buckle or a snap. One purpose of the buckle 72 is to make it possible to carry the chair 10 across a user's back without having to pull the chair on over the carrier's head, which could cause discomfort. Instead, using the buckle 72, the carrying strap 66 can be fastened around the carrier's shoulders messenger-style. To remove the chair from the carrier's back, the buckle 72 can be opened to release the carrying strap 66.

Now from the mutually nested or flattened configuration of FIG. 2, the left and right pluralities 12, 14 of the side frame members of the chair 10 can be folded about the now-coaxial joints 34, 36, 38, 40 and toward the vertical mid-plane of the chair, from the flattened configuration of the chair to a collapsed configuration as shown in FIG. 3.

As illustrated, the joints 34, 36, 38, 40 are located at one side of the collapsed chair 10. At the other side are the left and right pluralities 12, 14 of the side frame members 16, 18, 20, 22, 24. The cross members 26, 28, 30, 32 extend from their respective joints 34, 36, 38, 40 across the chair 10 to their respective side frame members 16, 18, 24. The flexible panels 62, 64 are folded within the cross members 26, 28, 30, 32. The left and right pluralities 12, 14 of side frame members have been juxtaposed. As illustrated, the carrying strap 66 lays loose outside the collapsed frame so that it can be easily grabbed and used to carry the collapsed chair.

Figure 4:
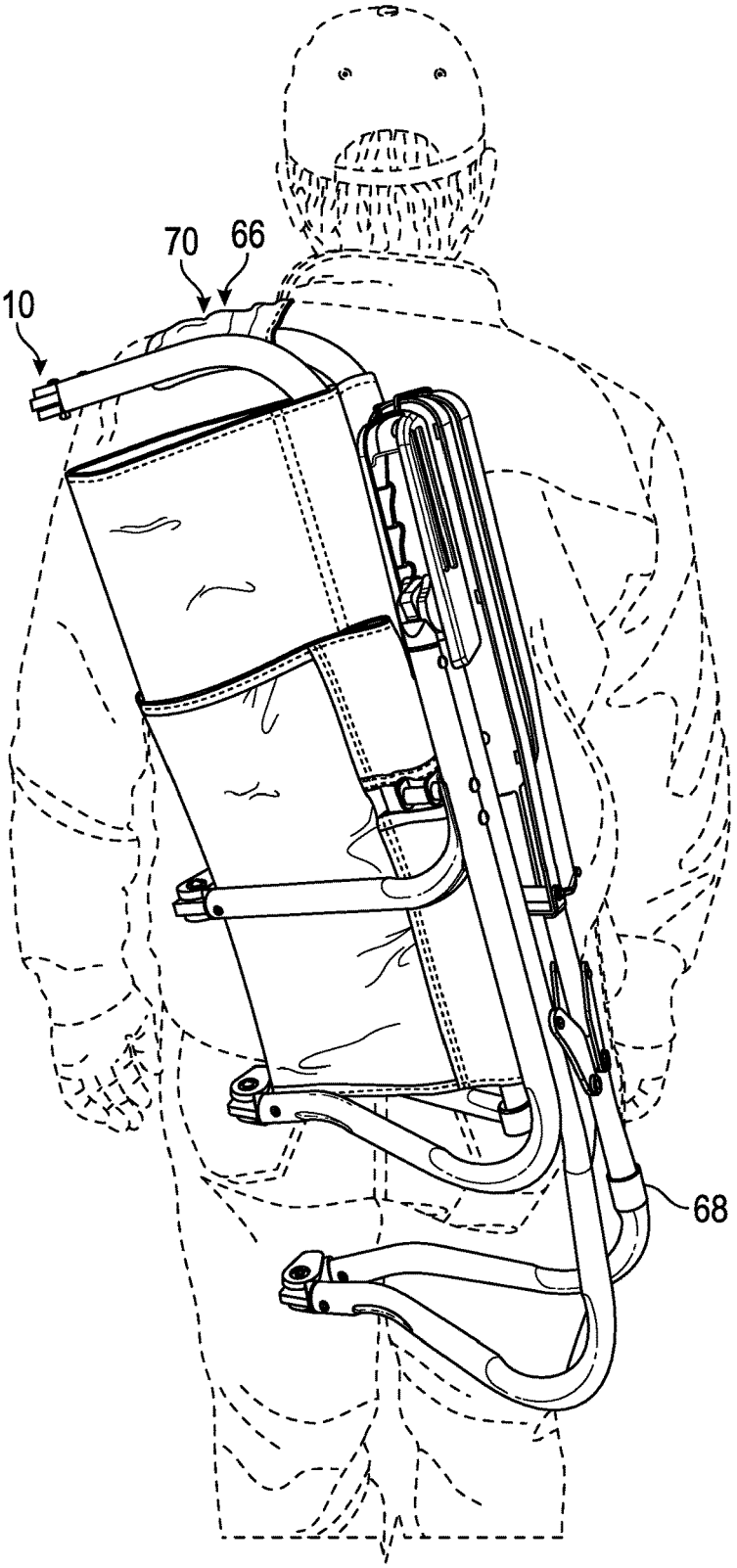
FIG. 4 shows the bi-fold chair of FIG. 3 being carried across a carrier's back.

In either the flattened configuration of FIG. 2 or the collapsed configuration of FIG. 3, the carrying strap 66 can be used to carry the chair 10 across a carrier's back or over a carrier's shoulder. FIG. 4 shows the chair 10 in the collapsed configuration of FIG. 3, being carried across a carrier's back. This is a messenger-style mode of carrying the chair, with the carrying strap 66 going across the carrier's chest, over one shoulder and under the other. The pocket 74 that is provided on the carrying strap faces outward from the chair 10 at the front side of the carrier's body for receiving a cell phone or wallet. Thus, the phone or wallet is accessible. On the other hand, in the set-up configuration, when the carrying strap 66 has been flipped to the rear of the chair 10, the pocket 74 is elevated off the ground and in fact protected from the outside world because it now faces the back of the backrest 64.

FIG. 5, in which like components are numbered alike to those of FIGS. 1-4, shows a flattened folding chair 100, being carried over a carrier's shoulder. This is a shoulder bag mode of carrying the chair 100, with the carrying strap 66 going over and under the same shoulder. The carrying strap 66, by its attachment to the top brace 32 and to the rear leg 18 across the chair 100, helps to maintain the chair in its flattened configuration. The carrying strap 66 extends across the chair 100 at an offset from the chair's center of gravity, such that when the chair is carried over the carrier's shoulder the weight of the chair exerts an swinging force on the carrying strap 66. By "swinging force" is meant a force that tends to displace the chair 100 sideways from the center of the carrier's back so as to bring the center of gravity in line under the carrier's shoulder. Accordingly, the upper end 70 of the carrying strap 66 is made sufficiently broad to resist the swinging force, i.e. to keep the chair 100 in its place across the carrier's back. For example, the upper end 70 may be made about four to six inches broad so as to distribute the swinging force across the carrier's shoulder.

Moreover, with reference to either FIG. 4 or FIG. 5, the carrying strap 66 may be duplicated with the duplicate strap being attached at the side of the top brace and at the other rear leg 18. Accordingly, when the chair 10 is fully collapsed only one of the duplicate carrying straps can be used to carry the chair over the shoulder as shown in FIG. 4. On the other hand, when the chair 10 or 100 is in its flattened condition, both of the duplicate carrying straps may be used to carry the chair over both shoulders like a backpack.

While the present disclosure has been illustrated and described with respect to particular embodiments thereof, it should be appreciated by those of ordinary skill in the art that various modifications to this disclosure may be made without departing from the spirit and scope of the present disclosure.

What is claimed is:

1. A folding article of furniture comprising:

a plurality of first members;

a plurality of second members that support the plurality of first members in a set-up configuration of the article of furniture;

a panel supported by the first and/or second members for supporting an occupant of the article of furniture in a set-up configuration of the article of furniture;

a plurality of first joints that connect the plurality of second members, wherein the plurality of first joints in the set-up configuration of the article of furniture define a plurality of mutually parallel axes about which the second members can be folded from the set-up configuration of the article of furniture to a mutually nested configuration of the article of furniture;

a plurality of second joints that connect the plurality of first members and that in the set-up configuration of the article of furniture define a plurality of mutually skewed axes about which the article of furniture cannot be folded, thus locking the first members in extended positions in the set-up configuration of the article of furniture, wherein the plurality of second joints in the mutually nested configuration of the article of furniture define a plurality of mutually parallel axes about which the first members can be folded from the mutually nested configuration of the article of furniture to a collapsed configuration of the article of furniture, in which the first members take folded positions; and a carrying strap that is attached from one of the first members to one of the second members, such that in the collapsed configuration of the article of furniture, the carrying strap extends across a center of gravity of the article of furniture, wherein said carrying strap includes a pocket at an upper end of the carrying strap;

wherein in the set-up configuration of the article of furniture, the pocket opens toward the article of furniture and, in the collapsed configuration of the article of furniture, the pocket opens away from the article of furniture.

2. The article of furniture as claimed in claim 1 wherein the carrying strap includes a padded upper end.

3. The article of furniture as claimed in claim 1 wherein the carrying strap includes a buckle releasably connecting an upper end of the carrying strap with a lower end of the carrying strap.

4. A folding chair comprising:

left and right front legs;

left and right rear legs pivotally connected to the respective front legs at wrist joints;

left and right seat supports pivotally connected to the respective front legs at front joints;

left and right back supports pivotally connected to the respective seat supports by seat joints;

left and right cranks pivotally connected to the seat joints and pivotally connected to the respective rear legs by crank joints;

left and right arm rests pivotally connected to the respective back supports at elbow joints;

left and right front leg braces rigidly attached to their respective front legs and mutually pivotally connected by an upper pivot;

left and right rear braces rigidly attached to their respective rear legs and mutually pivotally connected by a rear pivot;

left and right top braces rigidly attached to their respective back supports and mutually pivotally connected by a top pivot;

at least one flexible panel supported among the seat supports and the back supports; and a carrying strap that is attached to one of the rear legs and to the corresponding one of the top braces;

wherein the chair has a set-up configuration in which the left and right leg braces, rear braces, and top braces are in extended positions to space apart the left and right seat supports and back supports to hold the panel as a seat for an occupant, while the left and right seat supports are at an oblique angle from the left and right back supports;

wherein the lower pivot, the upper pivot, the rear pivot, and the top pivot define a plurality of first axes that are mutually skewed in the set-up configuration of the chair, while the wrist joints, front joints, seat joints, crank joints, and elbow joints define a plurality of second axes that are mutually parallel in the set-up configuration of the chair;

wherein the chair can be folded from the set-up configuration about the plurality of second axes to a flattened configuration in which the left front leg, rear leg, arm rest, seat support, and back support are juxtaposed at a left side and the right front leg, rear leg, arm rest, seat support, and back support are juxtaposed at a right side, and in which the plurality of first axes become substantially mutually parallel with the lower and upper leg braces, the rear braces, and the top braces still in their extended positions; and wherein the chair can be folded from the flattened configuration about the plurality of first axes to a collapsed configuration, in which the left and right front and rear legs, arm rests, seat supports, and back supports all are juxtaposed with the lower and upper leg braces, the rear braces, and the top braces all in folded positions about their respective joints and with the carrying strap extending across a center of gravity of the chair.

5. The chair as claimed in claim 4 wherein the carrying strap includes a buckle releasably connecting an upper end of the carrying strap to a lower end of the carrying strap.

6. The chair as claimed in claim 5 wherein the upper end of the carrying strap is padded.

7. The chair as claimed in claim 5 wherein the upper end of the carrying strap includes a pocket.

8. The chair as claimed in claim 7 wherein in the set-up configuration of the chair the pocket opens toward the chair and in the collapsed configuration of the chair the pocket opens away from the chair.

9. A folding chair comprising:

left and right front legs;

left and right rear legs pivotally connected to the respective front legs at wrist joints;

left and right seat supports pivotally connected to the respective front legs at front joints;

left and right back supports pivotally connected to the respective seat supports by seat joints;

left and right cranks pivotally connected to the seat joints and pivotally connected to the respective rear legs by crank joints;

left and right arm rests pivotally connected to the respective back supports at elbow joints;

a front leg brace attached across the front legs;

a rear brace attached across the rear legs;

a top brace attached across the back supports;

at least one flexible panel supported among the seat supports and the back supports; and a carrying strap that is attached to one of the rear legs and to the top brace;

wherein the chair has a set-up configuration in which the left and right seat supports are at an oblique angle from the left and right back supports, and the chair has a flattened configuration in which the left front leg, rear leg, arm rest, seat support, and back support are juxtaposed at a left side and the right front leg, rear leg, arm rest, seat support, and back support are juxtaposed at a right side;

wherein the carrying strap extends across the chair at an offset from a center of gravity of the chair in its flattened configuration for carrying the chair over a carrier's shoulder, such that when the chair is carried over a carrier's shoulder the weight of the chair exerts a swinging force on the carrying strap;

wherein an upper end of the carrying strap is made sufficiently broad to resist the swinging force and further includes a pocket;

wherein, in the set-up configuration of the chair, the pocket opens toward the chair and, in the flattened configuration of the chair, the pocket opens away from the chair.

10. The chair as claimed in claim 9, wherein the upper end of the carrying strap is padded.

11. The chair as claimed in claim 9, wherein the carrying strap includes a side-release buckle connecting the upper end of the carrying strap to a lower end of the carrying strap.

* * * * *